United States Patent [19]

Iijima et al.

[11] Patent Number: 4,672,822

[45] Date of Patent: Jun. 16, 1987

[54] REFRIGERATING CYCLE APPARATUS

[75] Inventors: Hitoshi Iijima, Amagasaki; Hiroaki Hama, Wakayama, both of Japan

[73] Assignee: Mitsubishi Denki Kabushiki Kaisha, Tokyo, Japan

[21] Appl. No.: 809,798

[22] Filed: Dec. 17, 1985

[30] Foreign Application Priority Data

Dec. 18, 1984 [JP] Japan ..... 59-266595

[51] Int. Cl.[4] ..... F25B 43/02

[52] U.S. Cl. ..... 62/468; 62/510

[58] Field of Search ..... 62/510, 84, 468, 117, 62/471

[56] References Cited

U.S. PATENT DOCUMENTS 2,196,687 4/1940 Steinfeld ..... 62/510 X
4,411,141 10/1983 Hara ..... 62/510 X
4,586,351 5/1986 Igarashi et al. ..... 62/510 X

FOREIGN PATENT DOCUMENTS 54-20020 7/1979 Japan .
56-27868 3/1981 Japan .

OTHER PUBLICATIONS

"Die Kalte-und Klimatechinik", 3/1979, pp. 124, 131, 132.

*Primary Examiner*—William E. Wayner
*Attorney, Agent, or Firm*—Burns, Doane, Swecker & Mathis

[57] ABSTRACT

The refrigerating cycle apparatus of the invention is provided with a pair of condenser and evaporator, two compressors, and a riser piping for rising therethrough a refrigerant and provided at a suction pipe for one compressor, the suction pipe for the other compressor being connected with the riser piping, so that even when the flood back condition occurs during the individual operation of the one compressor, both compressors are adapted to maintain a proper oil quantity therein.

5 Claims, 2 Drawing Figures

REFRIGERATING CYCLE APPARATUS

BACKGROUND OF THE INVENTION

1. Field of the Invention

The present invention relates to a refrigerating cycle apparatus provided two compressors with and condenser and evaporator.

2. Description of the Prior Art

The refrigerating cycle apparatus provided with two or more compressors with respect to a condenser and evaporator so that one or a plurality of compressors are shut down for carrying out load control has hitherto been disclosed in the Japanese Patent Publication No. 54-20020 (1979) and the Japanese Patent Application Laid-Open No. 56-27868 (1981).

FIG. 1 is a system diagram of construction of the conventional refrigerating cycle apparatus in which two compressors 1 and 2 are provided.

In the drawing, the first compressor 1 has a suction pipe 7 from which a suction pipe 8 for the second compressor 2 is branched. The first and second compressors 1 and 2 are connected at the discharge sides thereof through check valves 11 and 10 to the inlet side of a condenser 3 for liquefying a refrigerant, the condenser 3 being connected at the outlet side thereof through a thermal expansion valve 4 to an inlet side of an evaporator 5 for vaporizing the refrigerant. In addition, a temperature sensing cylinder 41 for the thermal expansion valve 4 is provided at an outlet pipeline of the evaporator 5. The outlet pipeline of the evaporator 5 is also connected to the inlet side of an accumulator 6 for removing liquid drops from the refrigerant gas, the accumulator 6 being connected to the outlet side of the suction pipe of the first compressor 1.

Shells of the first compressor 1 and that of the second compressor 2 are connected at the lower portions with each other by an equalizer pipe 9 in order to equalize the internal oil amounts in the shells.

The conventional refrigerating cycle apparatus constructed as above-mentioned discharges a high temperature and high pressure refrigerant from the first and the second compressors 1 and 2, so that the refrigerant is fed to the condenser 3 via the check valves 11 and 10 and liquified in the condenser 3. Next, the pressure of the liquified refrigerant, that is, liquid refrigerant, is reduced by the thermal expansion valve 4 and thereafter revaporized by the evaporator 5 so as to be drawn again into the first and the second compressors 1 and 2 via the accumulator 6, thus forming the refrigerating cycle provided with two compressors 1 and 2 with respect to condenser 3 and evaporator 5.

In this refrigerating cycle, the suction pipe 7 for the first compressor 1 has a riser piping *7a* through which the refrigerant rises from the accumulator 6 and a descending piping *7b* through which the refrigerant, having passed the riser piping *7a*, descends, the suction pipe 8 for the second compressor 2 being connected with an intermediate portion of the descending piping *7b* in a manner that the utmost end of suction pipe 8 is plunged and projected inside of the suction pipe 7. Therefore, oil drops through the descending piping *7b* by the gravity and is not drawn into the suction pipe 8 for the second compressor 2. Hence, although the refrigerant and the oil are drawn into the first compressor 1, only the refrigerant is drawn into the second compressor 2.

On the other hand, the suction pipe 7 for the first compressor 1 and that 8 for the second compressor 2 are selected in diameter so that pressure $P_2$ in the shell of the second compressor 2 is lower than that $P_1$ in the shell of the first compressor 1. Concretely, the suction pipe 8 for the second compressor 2 is longer than the suction pipe 7 for the first compressor 1 and smaller in an inner diameter than that of the descending piping *7b* from which the suction pipe 8 is branched. Hence, resistance of the suction pipe 8 becomes larger than that of the descending piping *7b*, whereby the pressure $P_2$ in the shell of the second compressor 2 is lower than that $P_1$ in the shell of the first compressor 1.

Thus, even when the oil is to be drawn only in the first compressor 1, the difference in pressure feeds a considerable amount of oil into the second compressor 2 through the equalizer pipe 9.

Such oil-feed operation occurs not only when the two compressors 1 and 2 are simultaneously operated but also when the first compressor 1 is shut down and the second compressor 2 is operated in unloading condition. In other words, the oil discharged from the accumulator 6, which drops by gravity through the descending piping *7b* of the suction pipe 7 for the first compressor 1, enters directly into the first compressor 1, the refrigerant being drawn into the second compressor 2 through the suction pipe 8.

The pressure $P_1$ in the shell of the first compressor 1 under shutdown, as above-mentioned, is higher than the pressure $P_2$ in the shell of the second compressor 2 under operation ($P_1 > P_2$), whereby the oil drawn into the first compressor 1 under shut-down transfers at part above the equalizer pipe 9 to the second compressor 2 under operation, through the equalizer pipe 9, when the oil level exceeds the height of the equalizer pipe 9. Accordingly, the oil level in the first compressor 1 under shutdown is substantially level with the height of equalizer pipe 9, resulting in that the oil level in the second compressor under operation becomes fairly high.

Furthermore, in the aforesaid conventional refrigerating cycle apparatus, when the second compressor 2 is individually operated on condition of flood back wherein gas refrigerant including liquid refrigerant is compressed, the liquid refrigerant is separated from the gas refrigerant and drops by the gravity through the descending piping *7b* of the suction pipe 7 to thereby flow into the first compressor 1, thus presenting the phenomenon of the socalled excessive accumulation of the liquid refrigerant in the crank case during the off-cycle. Hence, in the bottom portion of the shell of the first compressor 1 are gradually collected the oil and the liquid refrigerant, so that after once collected over the height of equalizer pipe 9, the surpluses of them will transfer into the second compressor 2. In this case, since the specific gravity of oil is smaller than that of refrigerant, only the refrigerant is collected over the height of the equalizer pipe 9 in the shell bottom of the first compressor 1. Accordingly, the problems have been occurred that the oil in the first compressor 1 is in short supply causing improper lubrication when starting operation, and that the oil in the second compressor 2 is oversupplied which leads to an increase the throwing out of oil according to a foaming action and overheat by a discharge muffler in the shell and then to an excessive rise of the oil temperature.

OBJECT OF THE INVENTION

In the light of the above problem, the present invention has been designed.

A first object of the invention is to provide a refrigerating cycle apparatus which can keep a proper amount of oil in the respective compressors even when the flood back occurs during the individual operation of either of the two compressors.

A second object of the invention is to provide a refrigerating cycle apparatus which can prevent an improper lubrication and an excessive rise of the oil temperature in the compressor even when the flood back occurs during the individual operation of either compressor.

A third object of the invention is to provide a refrigerating cycle apparatus simple in construction to ensure the attainment of the above objects.

The above and further objects and features of the invention will more fully be apparent from the following detailed description with reference to accompanying drawings.

DETAILED DESCRIPTION OF THE INVENTION

Next, an embodiment of a refrigerating cycle apparatus of the invention will be detailed with reference to the accompanying drawing.

Figure 1:
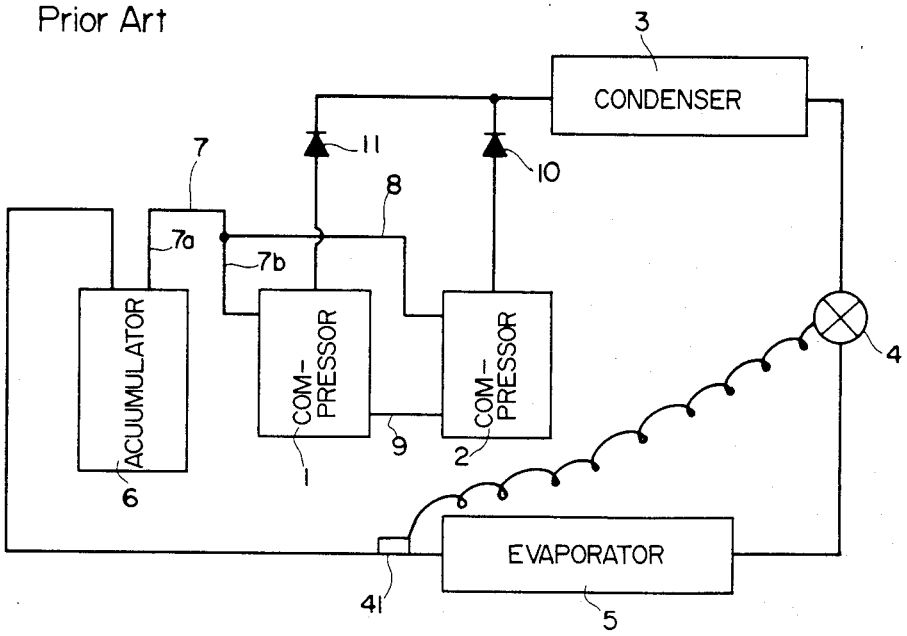
Fig. 1 Prior Art
FIG. 1 is a system diagram of the conventional refrigerating cycle apparatus of an ordinary construction.
Figure 2:
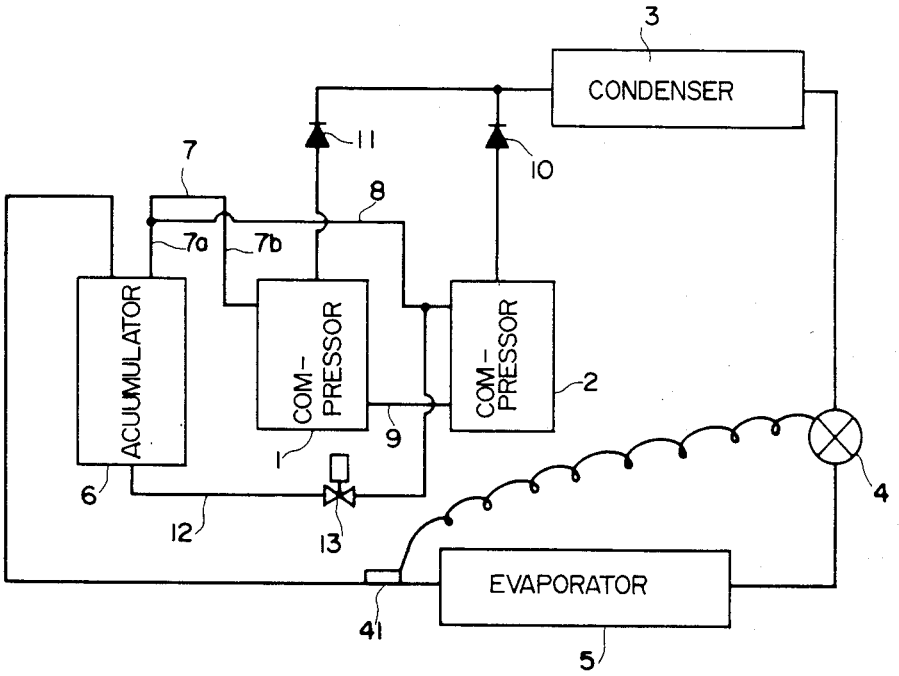
FIG. 2 is a system diagram of a refrigerating cycle apparatus of the invention.

In FIG. 2, the components indentical with those in FIG. 1 illustration of the prior art are designated by the identical reference numerals.

In FIG. 2, reference numeral 1 designates a first compressor and 2 designates a second compressor. A suction pipe 8 for the second compressor 2 is branched from a suction pipe 7 for the first compressor 1, as the same as the conventional example, but in the present invention, the suction pipe 8 for the second compressor 2 is connected to an intermediate portion of a riser pipe 7*a* of the suction pipe 7 for the first compressor 1.

The refrigerating cycle apparatus of the invention is similar to the conventional example in that the outlet sides of both the compressors 1 and 2 are connected through the check valves 11, 10 to an inlet side of a condenser 3 for liquefying a refrigerant, and that the outlet side of the condenser 3 is connected through a thermal expansion valve 4 to one end of an evaporator 5 for vaporizing the refrigerant, and that a temperature sensing cylinder 41 for the thermal expansion valve 4 is provided at an outlet pipeline of the evaporator 5, the outlet pipeline thereof being connected to an inlet side of an accumulator 6 for removing liquid drops from a refrigerant gas, and that the suction pipe 7 for the first compressor 1 is connected to an outlet side of the accumulator 6.

Also, shells of the first compressor 1 and that of the second compressor 2 are connected at the lower portions with each other by means of an equalizer pipe 9 in order to equalize the amount of oil in each shell.

The refrigerating cycle apparatus of the invention, however, is different from the conventional one in that a by-pass pipe 12 is provided in order to connect the bottom of the accumulator 6 and the suction pipe 8 for the second compressor 2 interposing on the way a solenoid controlled stop valve 13.

Next, explanation will be given on operation of the refrigerating cycle apparatus of the invention.

The high temperature and high pressure refrigerant discharged from the first and the second compressors 1 and 2 is fed to the condenser 3 through check valves 11 and 10 respectively and liquefied in the condenser 3. Then, the liquefied refrigerant, that is, liquid refrigerant, is to be reduced in pressure by the thermal expansion valve 4, thereafter vaporized by the evaporator 5, and drawn again into the first and the second compressors 1 and 2 through the accumulator 6. Thus, a refrigerating cycle is formed which is provided with two compressors 1 and 2 with respect to a condenser 3 and evaporator 5.

In a case where the first and second compressors 1 and 2 are operated, oil returned from the accumulator 6, as the same as the conventional example in FIG. 1, is drawn only into the first compressor 1. The refrigerating cycle apparatus of the invention, as the same way as the conventional example in FIG. 1, is so composed that the internal pressure $P_2$ of the second compressor 2 becomes lower than that $P_1$ of the first compressor 1 by using different pipes in diameter between the suction pipe 7 for the first compressor 1 and the suction pipe 8 for the second compressor 2. Hence, part of the oil, drawn into the first compressor 1 and to be collected above the height the equalizer pipe 9, is drawn therethrough into the second compressor 2.

On the other hand, in a case where only the second compressor 2 is individually operated, the gas refrigerant discharged from the accumulator 6 is at first drawn into the suction pipe 7 for the first compressor 1, but since the first compressor 1 is not operated, the gas refrigerant is not drawn into the suction pipe 7 toward the first compressor 1 beyond the branch position of the suction pipe 8 from the riser piping 7*a*, but drawn into the suction pipe 8 on the way of the riser piping 7*a* and then into the second compressor 2.

Therefore, the oil drawn into the suction pipe 7 from the accumulator 6 is not drawn into the first compressor 1, but entirely drawn into the second compressor 2.

Now, in the refrigerating cycle apparatus of the invention, in a case where the second compressor 2 is individually operated under the condition of flood-back in which the gas refrigerant including the liquid refrigerant is compressed together, the liquid refrigerant is separated from the gas refrigerant. The refrigerating cycle apparatus of the invention, however, has the suction pipe 8 for the second compressor 2, branched from an intermediate portion fo the riser piping 7*a* of the suction pipe 7 for the first compressor 1 as the above-mentioned. Hence, the gas refrigerant, liquid refrigerant and oil, separated from each other, are not drawn into the first compressor 1, but entirely drawn into the second compressor 2 from the riser piping 7*a* through the suction pipe 8. In addition, the liquid refrigerant drawn into the second compressor 2 is heated by the high temperature portion of the second compressor 2 under operation, thereby being converted into the gas refrigerant.

Accordingly, even when the flood back is caused during the individual operation of the second compressor 2, the liquid refrigerant and oil do not flow into the first compressor 1 without increasing the amount which has been collected, whereby the problems such as the shortage of the oil in the first compressor 1 and the overabundance of the oil in the second compressor 2, being occurred in the aforesaid conventional apparatus, do not occur.

Incidentally, in the refrigerating cycle apparatus of the invention, when the second compressor 2 is individually operated, it is possible that the oil and liquid refrigerant (the latter only in the flood back condition) may not be drawn sufficiently into the suction pipe 8 through the riser piping 7*a*, and be collected in the bottom of the accumulator 6. In such case, however, the solenoid valve 13 at the by-pass pipe 12 only needs to be opened. By this operation the liquid refrigerant and the oil staying in the bottom of the accumulator 6 is drawn into the second compressor 2 via the by-pass pipe 12, whereby there is no fear of insufficient amount of oil in the second compressor 2.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A refrigerating cycle apparatus, comprising:

a condenser and an evaporator;

first and second compressors connected with each other by an equalizer pipe for equalizing an internal oil amount in a shell of each of said first and second compressors; and a suction pipe for said first compressor being connected to a low pressure pipe at the outlet side of said evaporator, and a suction pipe for said second compressor being branched from said suction pipe for said first compressor;

said suction pipe for said first compressor having a riser piping through which a refrigerant rises and said suction pipe for said second compressor is connected to said riser piping; and a by-pass pipe provided connecting the upstream side of said riser piping to said suction pipe for said second compressor; and a stop valve interposed within said by-pass pipe.

2. A refrigerating cycle apparatus as set forth in claim 1, wherein said stop valve at said by-pass pipe is a solenoid valve.

3. A refrigerating cycle apparatus as set forth in claim 1, wherein said riser piping is provided between an accumulator provided at the outlet side of said evaporator and said first compressor.

4. A refrigerating cycle apparatus as set forth in claim 1, wherein said by-pass pipe is provided between the bottom of said accumulator and said suction pipe for said second compressor.

5. A refrigerating cycle apparatus as set forth in claim 4, wherein said stop valve at said by-pass pipe is a solenoid valve.

* * * * *